US006564963B2

(12) United States Patent
Simpson

(10) Patent No.: US 6,564,963 B2
(45) Date of Patent: May 20, 2003

(54) DISPENSER BOX

(75) Inventor: Raymond Simpson, Oakpark, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/098,139

(22) Filed: Mar. 13, 2002

(65) Prior Publication Data

US 2002/0092860 A1 Jul. 18, 2002

Related U.S. Application Data

(63) Continuation of application No. 09/638,882, filed on Aug. 15, 2000, now Pat. No. 6,367,654, which is a continuation-in-part of application No. 09/130,445, filed on Aug. 6, 1998, now Pat. No. 6,123,221, which is a continuation-in-part of application No. 08/999,846, filed on Oct. 9, 1997, now Pat. No. 5,979,699.

(51) Int. Cl.[7] ..... B65H 1/00
(52) U.S. Cl. ..... 221/58; 312/62
(58) Field of Search ..... 221/45, 46, 33, 221/48, 49, 56, 58, 47; 266/556, 812; 312/62

(56) References Cited

U.S. PATENT DOCUMENTS

| | | | | |
|---|---|---|---|---|
| 2,027,671 A | * | 1/1936 | Broeren | 312/62 |
| 2,237,424 A | | 4/1941 | Hope | 312/62 |
| 2,253,742 A | | 8/1941 | West et al. | 312/62 |
| 4,993,590 A | | 2/1991 | Windorski | 221/46 |
| 5,165,570 A | | 11/1992 | Windorski et al. | 221/46 |
| 5,363,985 A | | 11/1994 | Cornell | 221/46 |
| 5,390,820 A | | 2/1995 | Wright et al. | 221/52 |

FOREIGN PATENT DOCUMENTS

| | | | |
|---|---|---|---|
| EP | 0253308 | 1/1988 | 221/33 |

* cited by examiner

*Primary Examiner*—Kenneth W. Noland
(74) *Attorney, Agent, or Firm*—Quarles & Brady LLP

(57) ABSTRACT

The present invention discloses a dispenser box allowing for the removal of individual coupons without the chance of another coupon being removed at the same time. The dispenser comprises walls defining a cavity adapted to receive the stack of sheets, an opening through which the sheets may be individually dispensed, a flat bottom wall fitting within the dimensions of the four walls, and a resilient member to push the stack of sheets to the opening in the top wall of the dispenser.

15 Claims, 7 Drawing Sheets

COUPON OPENING CONSTRUCTION DETAIL

VIEW FROM BACK

DISPENSER BOX

This application is a Continuation of application Ser. No. 09/638,882 filed Aug. 15, 2000 now U.S. Pat. No. 6,367,654 which is a Continuation-in-Part of Ser. No. 09/130,445 filed Aug. 6, 1998, now U.S. Pat. No. 6,123,221, which is a Continuation-in-Part of application Ser. No. 08/999,846, filed Oct. 9, 1997, now U.S. Pat. No. 5,979,699.

BACKGROUND OF THE INVENTION

1. Field of the Invention

The present invention discloses a dispenser box allowing for the removal of individual coupons without the chance of another coupon being removed at the same time.

2. Description of the Prior Art

Over the years, there have been many dispenser boxes developed for the dispensing of sheets of paper or coupons of some sort. This type of device has become more important in the marketplace as grocery and other stores have installed coupon dispensers on their shelves to give consumers incentives to make impulse purchases based on lower prices given at their stores on any given day of the week.

To accommodate consumer needs, there have been a number of different paper dispensing devices over the years.

U.S. Pat. No. 2,253,742 (W. H. West et al.) discloses a dispenser for interfolded paper. The dispenser comprises a vertically disposed container having a dispensing opening and a spring-actuated follower plate in the container adapted to support a vertically disposed stack of interfolded paper sheets. A plate is secured to the under side of the cover at one side of the dispensing opening, and engages the upper end of the stack while maintaining a predetermined spacing between the stack and the dispensing opening. A second plate is secured to the underside of the cover, the ends of the plates adjacent the dispensing opening being rounded to form deflecting surfaces.

U.S. Pat. No. 5,390,820 (Wright et al.) discloses an elevating dispensing device for flexible sheet material. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform.

U.S. Pat. No. 2,237,424 (S. N. Hope) discloses a sheet dispenser comprising a casing adapted to contain a pack of interfolded sheets and having opposite end walls with inwardly directed embossments adjacent to the opposite sides of the casing. A pair of cover members extends between the casing end walls and having end walls with outwardly directed embossments adapted to register with the casing embossments. A coiled spring for each cover member urges the cover member against the pack, with the spring surrounding a cooperating pair of the embossments on the casing and cover member.

U.S. Pat. No. 4,993,590 (Windorski) and U.S. Pat. No. 5,165,570 (Windorski et al.) are for dispensers for a stack of partially adhesive coated sheets stacked with the adhesive coating on each successive sheet disposed along alternate opposite sides of the stack and releasably adhering the sheets together.

In U.S. Pat. No. 4,993,590, the dispenser for adhesive coated sheets has opposed end surfaces having parallel upper ends adapted to be engaged by the opposite sides of the stack with the top sheets in the stack parallel to the adjacent upper ends, with the opposed end surfaces diverging slightly from each other toward the upper ends of the end surfaces to cause movement of the end portions of the stack along the end surfaces toward the upper ends in response to forces applied to the stack to sequentially remove sheets from the stack through the opening.

U.S. Pat. No. 5,979,699 (Simpson) discloses a dispenser box allowing for the removal of individual coupons without the chance of another coupon being removed at the same time. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

U.S. Pat. No. 6,079,190 (Simpson) discloses a method for dispensing packaged bandages in a way that allows for the easy removal of the bandage from its package. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

U.S. Pat. No. 5,848,723 (Krautsack) discloses a coupon dispenser in the form of an integral, vacuum-molded thermoplastic sheet foldable upon itself to enclose a stack of coupons in a box-like container with opposed side wall openings which allow withdrawal of coupons from both sides of the dispensing container. Integrally molded mounting accommodation is provided at one end. In an alternative form, the coupon receptacle proper is separately inserted by halves, respectively, in each foldable part.

U.S. Pat. No. 6,053,356 discloses a coupon dispenser provided with at least one suction cup and, preferably, a pair of suction cups, connected to the dispenser box so that the box can be directly mounted on a window, refrigerator/freezer door, or any other substantially flat and smooth surface capable of supporting a suction cup.

U.S. Pat. No. 5,944,219 (Emoff et al.) discloses a pop-up coupon dispenser for small sheets which have a repositionable adhesive is provided with a flexible plastic cable tie. The dispenser includes a box filled with such sheets having an adhesive stripe along one margin and stacked in accordion fashion, the sheets being printed as manufacturer's coupons supplied to a retailer who attaches the box by the cable tie to a wire rack, to a cardboard display or other suitable support, such as a shelf, and cuts off the excess end of the cable tie. Customers can remove the coupons one-at-a-time and affix them by their adhesive backing to the product for which the coupon is redeemable. A check out cashier can, therefore, immediately determine that the purchaser is purchasing the product for which the coupon was issued.

SUMMARY OF THE INVENTION

This invention is for a dispenser for flexible sheets from a stack of sheets disposed one said sheet on top of another, allowing for the dispensing of individual sheets. The dispenser has walls defining a cavity for the stack of sheets. A first wall has an opening through which the sheets may be individually dispensed. A second wall is spaced from the first wall. A two pair of opposite walls connect the first and second walls with edges positioned along edges of the width of the first and second walls at opposite sides thereof. A biasing structure is positioned within the cavity in contact with the last sheet of the stack of sheets to impart a bend in the stack and bias it toward the opening in the first wall. Each flexible sheet is independent from one another and folded upon itself at a specific length so that an end of the first sheet is positioned at the opening in the first wall.

The first wall can be a top and the second wall can be a bottom. The pairs of opposite walls are end and side walls. Preferably, the top and bottom are parallel, the end walls are parallel and the side walls are parallel with the side walls being larger than the end walls.

The stack of sheets are positioned between the two long end walls wherein each flexible sheet from the stack of sheets is disposed one the flexible sheet on top of another the flexible sheet, each the flexible sheet being independent from one another and folded upon itself at a specific length, allowing for the dispensing of individual sheets.

In a preferred form, the bend imparted in the stack of sheets causes the end of the first sheet to be spaced from the stack so that it extends through the opening and the biasing structure is a plastic sheet that is rectangular when flat and can be bent into an arcuate shape.

In another preferred embodiment, the dispenser is made from one said single piece of flexible material being cut to allow for folding of said material to form said dispenser. The material may be selected from the group consisting of paper, styrene, and plastic.

This devices allows the consumer to easily remove a single coupon from the dispenser, by simply pulling the coupon on top from the dispenser.

BRIEF DESCRIPTION OF THE DRAWINGS

The invention will be better understood and further objects, characterizing features, details and advantages thereof will appear more clearly as the following description proceeds with reference to the accompanying diagrammatic drawings given by way of non limiting example only illustrating a presently preferred specific embodiment of the invention and wherein.

DESCRIPTION OF THE PREFERRED EMBODIMENT

Figure 1:
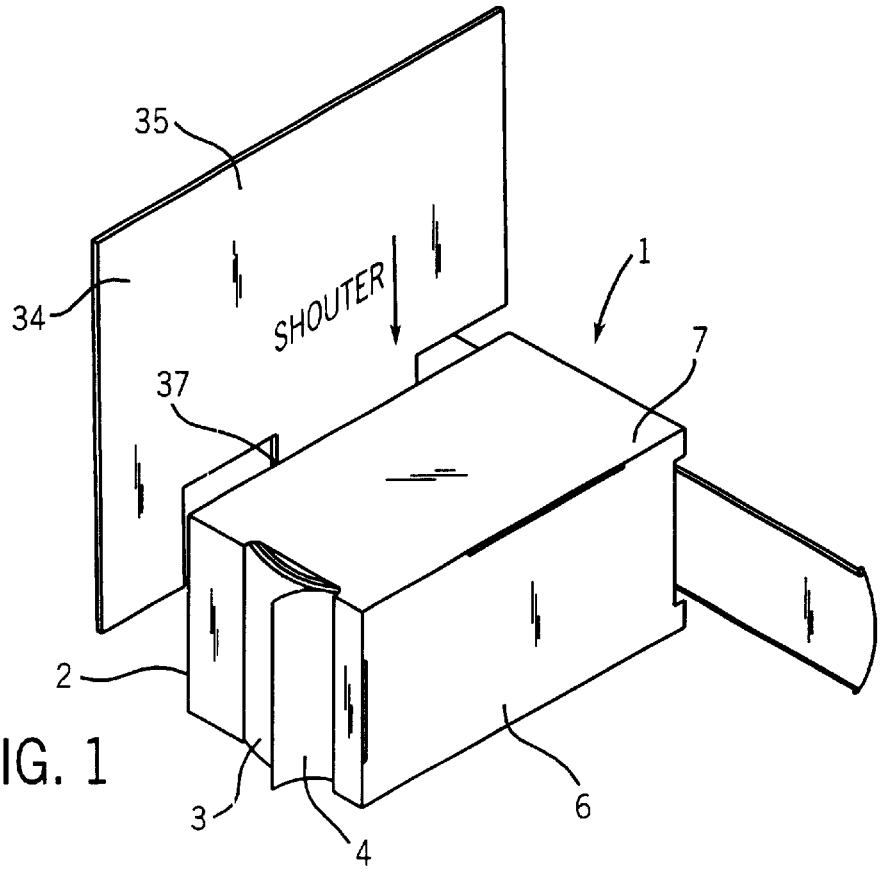
FIG. 1 is a perspective view of the coupon dispenser.
Figure 2:
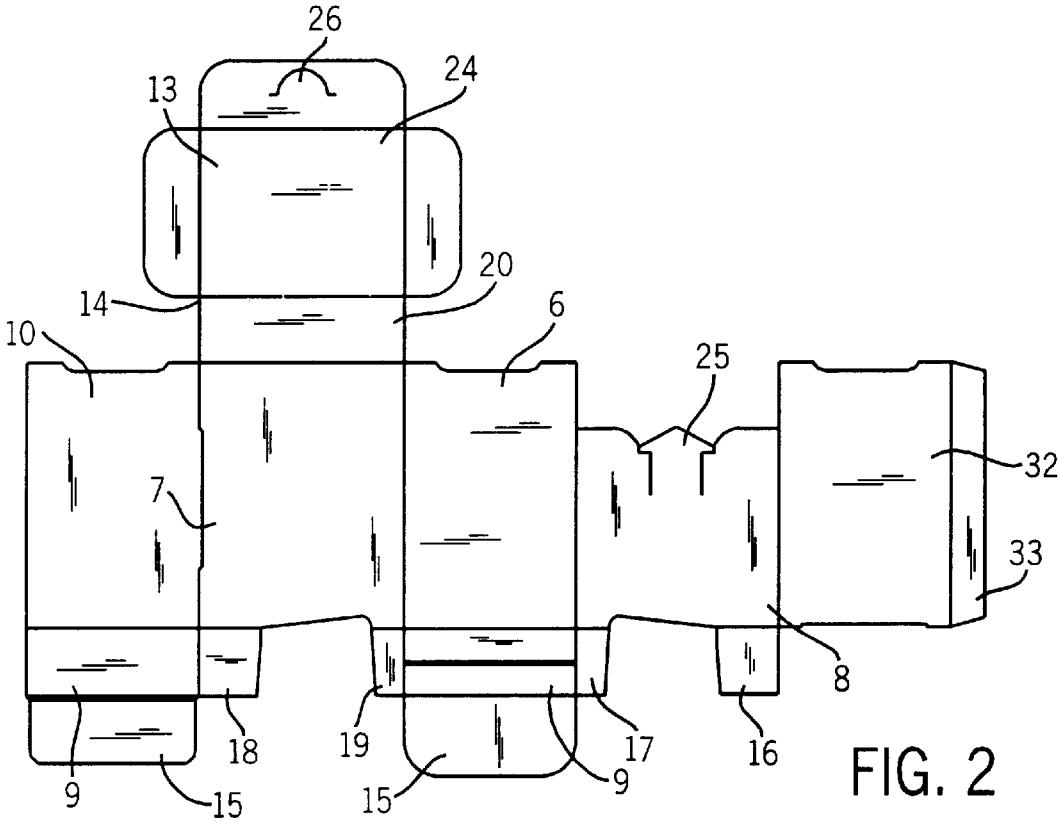
FIG. 2 is an overhead view of the unitary body of the coupon dispenser.
Figure 3:
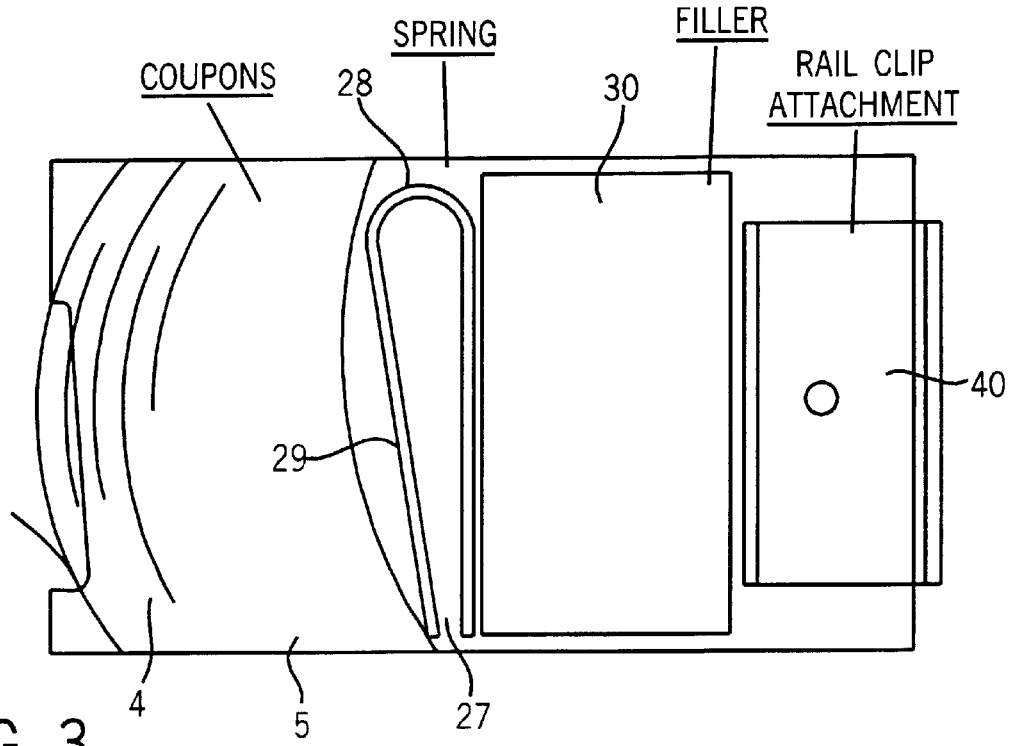
FIG. 3 is a cross sectional view of the coupon dispenser.
Figure 4:
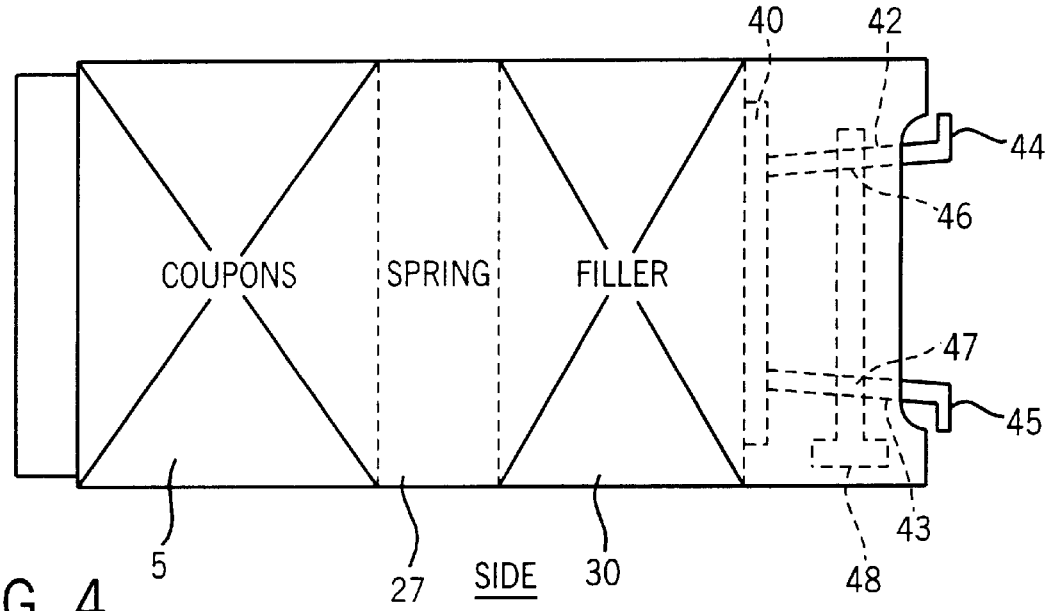
FIG. 4 is a schematic view of the coupon dispenser.
Figure 5:
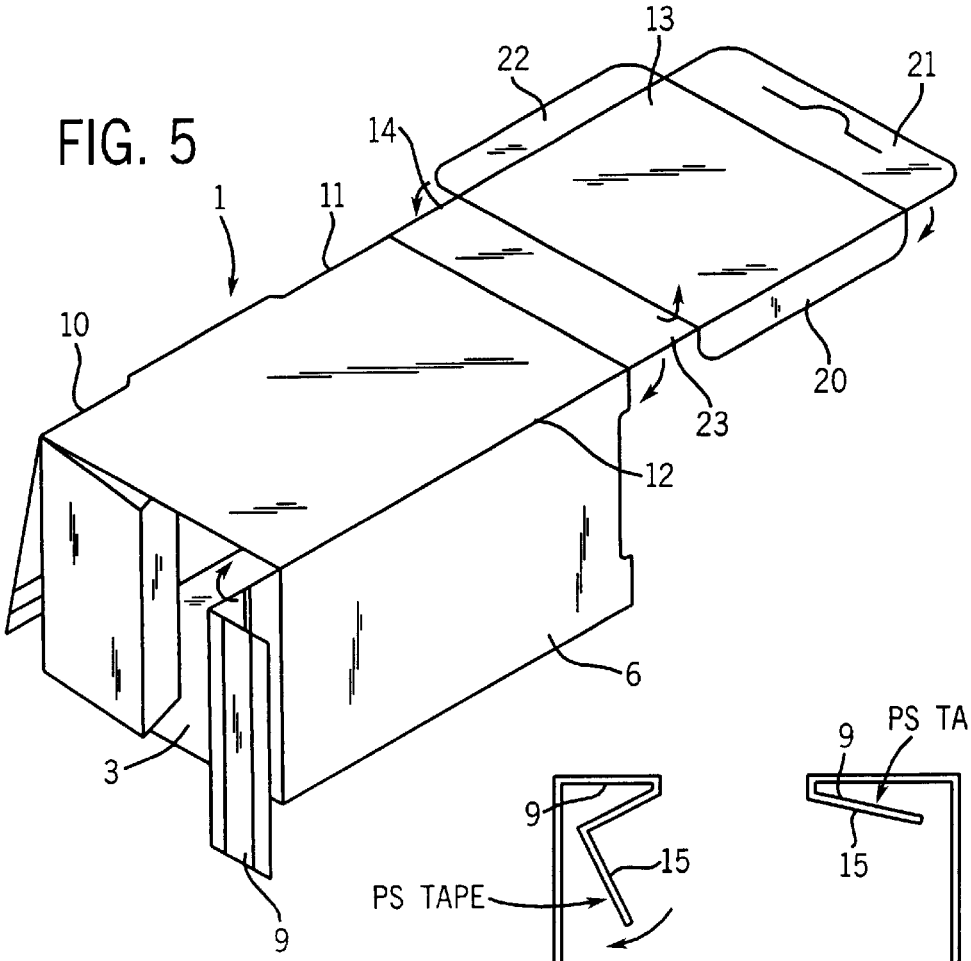
FIG. 5 is a perspective view of the coupon dispenser, showing the bottom wall in its open position.
Figure 6:
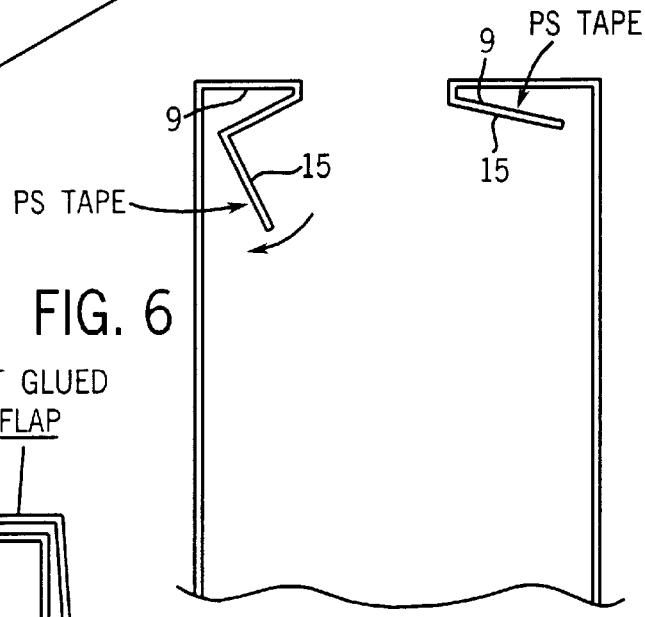
FIG. 6 is a cross sectional view showing the opening of the dispenser.
Figure 7:
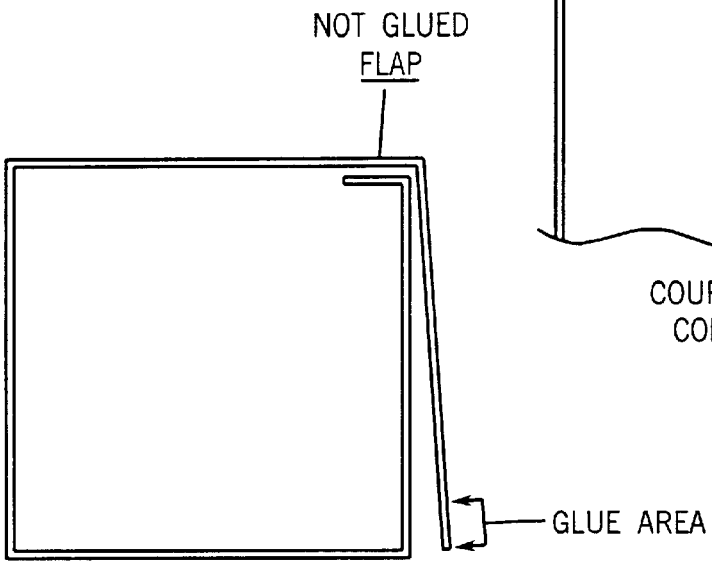
FIG. 7 is a cross sectional view from the bottom of the dispenser.
Figure 8:
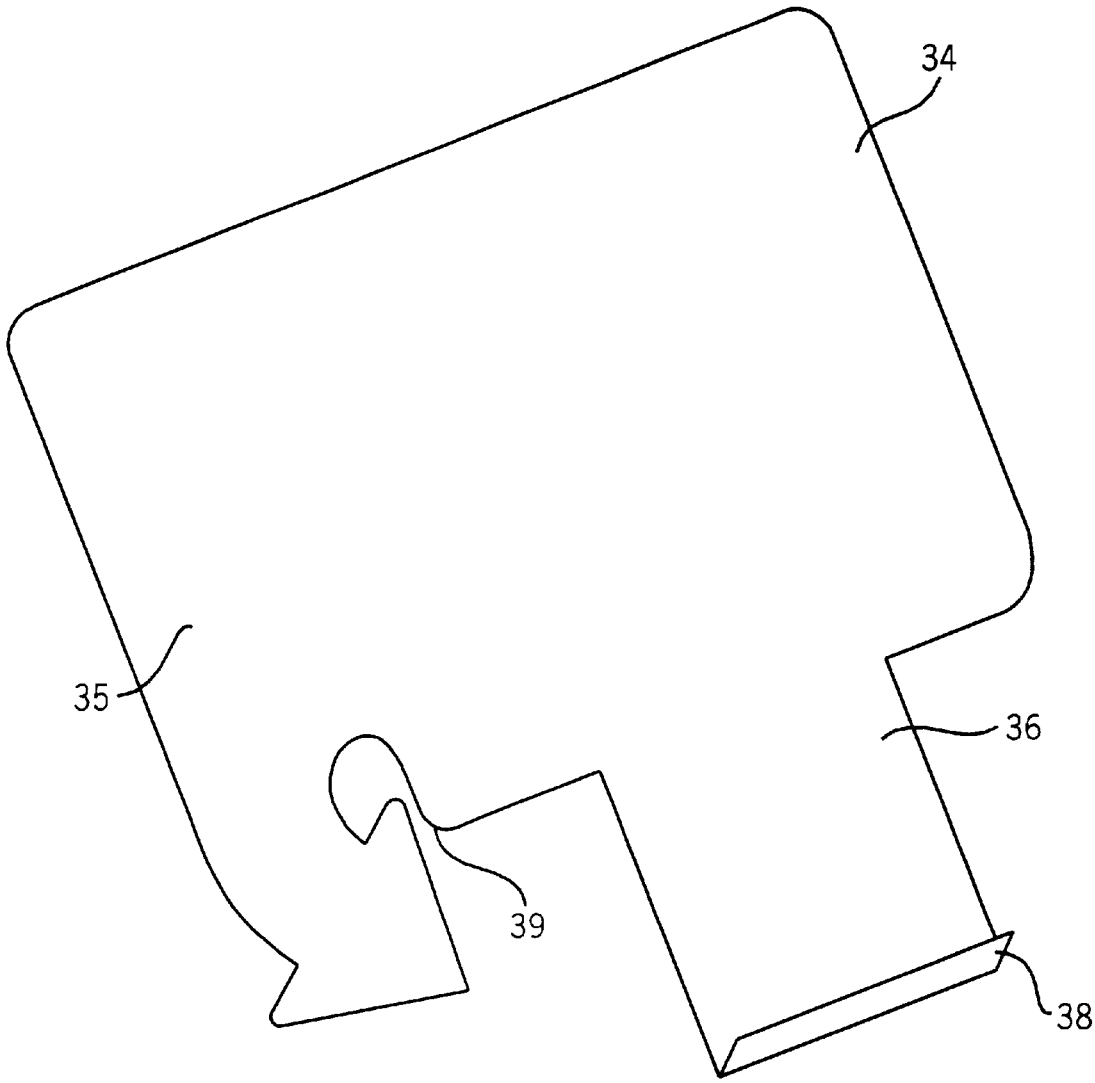
FIG. 8 is a perspective view of the advertising device of the dispenser.
Figure 9:
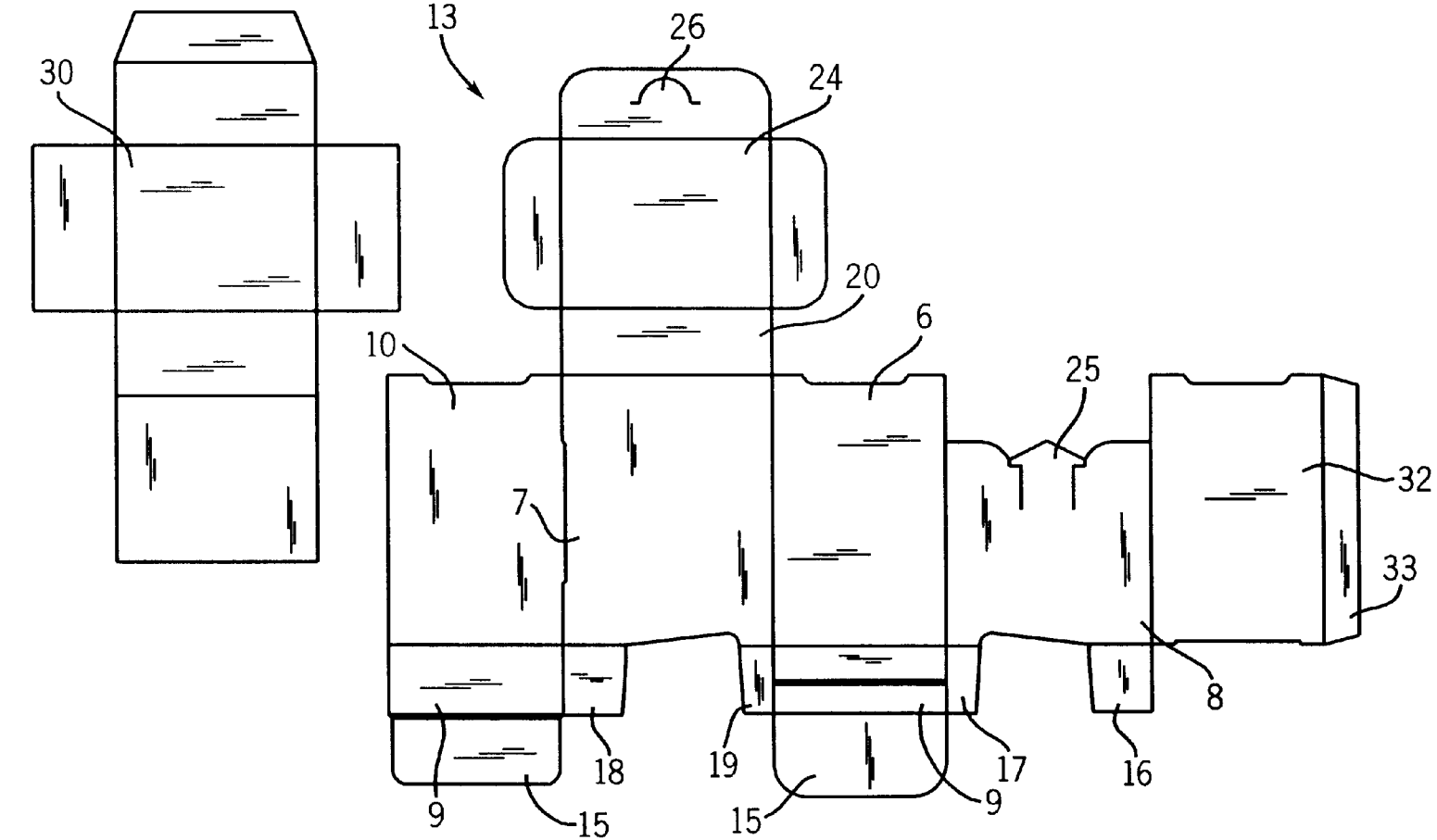
FIG. 9 is an overhead view of the unitary body, including the insert.
Figure 10:
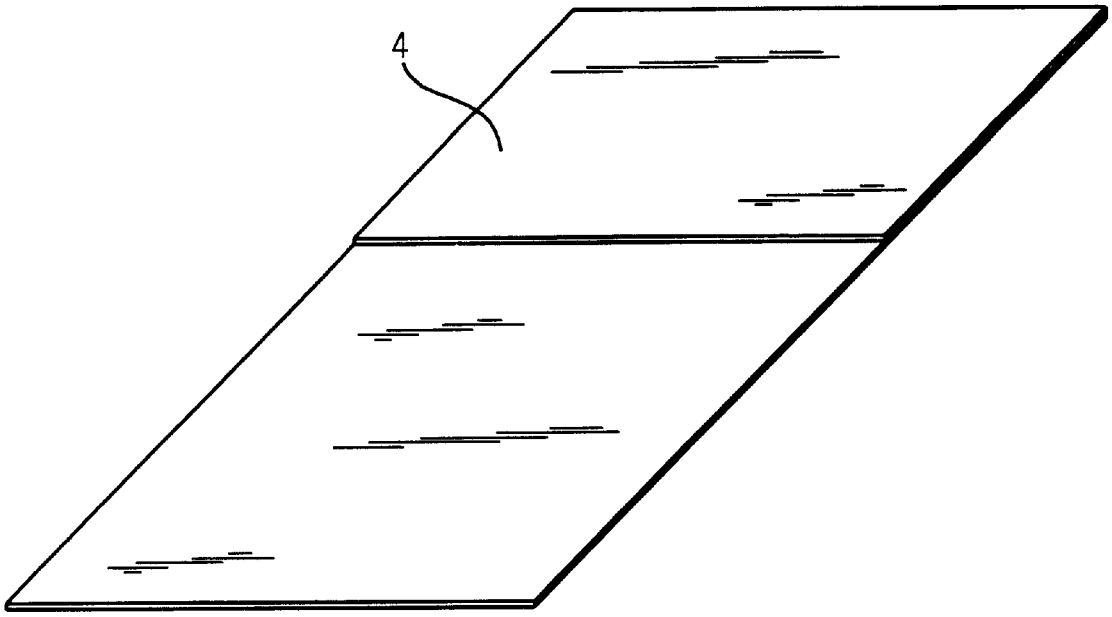
FIG. 10 is a perspective view of the coupon to be dispensed.
Figure 11:
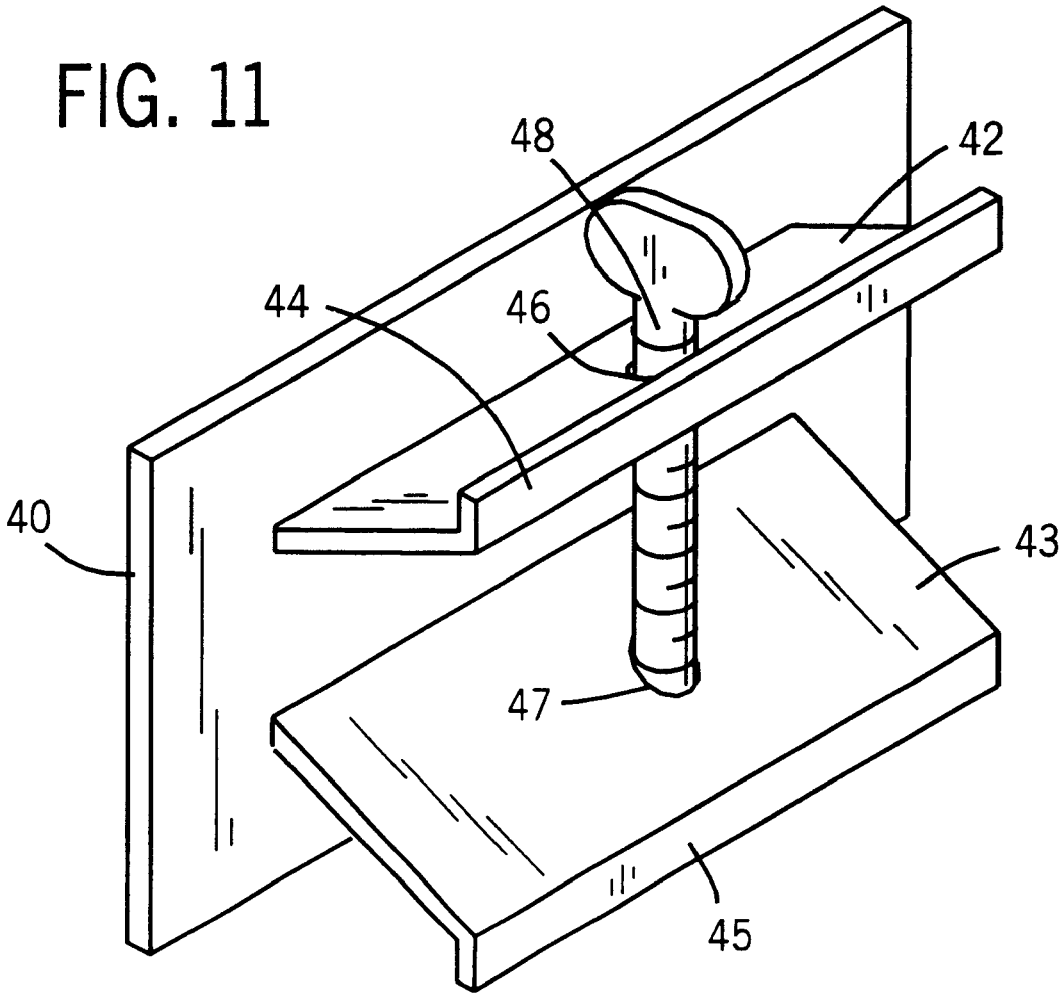
FIG. 11 is a perspective and view of the rail clip attachment.

Referring to FIGS. 1–11, the dispenser 1 comprises a top section 2 having an opening 3 through which coupons or flexible sheets 4 may be dispensed. The dispenser 1 which is generally rectangular or box shaped, 4 has a stack of flexible sheets disposed one on top of another and folded at a specific length, allowing for the dispensing of individual sheets. In a preferred embodiment of the invention, each coupon or flexible sheet 4 is folded upon itself. The body of the dispenser is preferably made of one unitary piece of material, cut to allow for folding of the material. Creases are made in the appropriate areas of the material to form edges. The material from which the dispenser is made is either paper, cardboard, styrene or plastic.

The dispenser 1 has two long flat end walls 6 and 10. Edges 11 and 12 of these long flat end walls 6 and 10 are positioned perpendicularly to two long flat side wails 7 and 8. The two long flat end walls 6 are parallel to each other, with each of the two long flat end walls 6 and 10 having the same dimensions as the other flat end wall. The two long flat side walls are preferably wider than the two long flat end walls. The two long flat side walls 7 and 8 are parallel to each other, and the two long flat side walls 7 and 8 parallel to one another.

The walls of the dispenser define an opening 3 through which coupons or sheets may be removed. The opening 3 is formed by opposing foldable flaps 9 formed by an extension from and integral with at least one of the walls, preferably from at least one, and most preferably from both long flat end walls 6 and 10. The foldable flaps 9 positioned at a top end of each of the flat end walls, comprises a lip 15 foldable upon flap 9. In a preferred embodiment, there is at least one tab positioned at each corner of a top end of two long flat side walls, resulting in four tabs 16, 17, 18, and 19 such that each foldable flap of a long flat end wall, fold over two tabs, thereby forming the opening of the dispenser.

The dispenser 1 also has a flat bottom wall 13 wherein at least one edge 14 of the flat bottom wall 13 is affixed to the bottom of the dispenser.: The flat bottom wall 13 fits within the dimensions of the two long flat side walls 7 and 8 and the two long flat end walls 6 and 10. In a preferred embodiment, the flat bottom wall 13 has bottom wall flaps 20, 21, 22, and 23 positioned around each side of a flat rectangular section 24. One of the flaps 20, 21, 22, and 23 is integrally connected to one of the walls of the dispenser. Each flap of said bottom wall is positioned against an inside section of each of a wall of said dispenser.

In another preferred embodiment, an insertion tab 25 on one of said walls, preferably on said long flat side wall, fits into a slip opening 26 in one of said flaps 20, 21, 22, and 23 of said bottom wall 13, allowing said long flat side wall 7 or 8, (preferably 8) to secure said bottom wall 13 in position.

In another preferred embodiment of the invention, since the dispenser is comprised of a unitary structure, one of the long flat end walls 6 further comprises an extension integral with the other long flat end wall 10, such that the extension forms one of the long flat side walls 8, and an inside support wall 32 for the other long flat end wall. The inside support wall further comprises a flap 33 integral with the inside support wall, with the flap 33 attachable to one of said long flat side walls 7.

At various other locations in and around the dispenser, the glue or tape may be used to secure the various sides or flap of the dispenser. The opposing flaps 9 and lips 15 are glued or taped into position.

A resilient member is used to push the tack of sheets 5 up to the opening 3 in the top wall 2 of the dispenser 1. Any form of spring may be used. In one embodiment of the invention, the member used to push the sheets to the opening 3 of the dispenser is an arc type structure 27 positioned underneath the stack of sheets 5. This arc type structure 27 is positioned between the long flat end walls 6 and 10 and above the flat bottom wall 13. In one embodiment of the invention, one side 29 of the arc type structure is in communication with the bottom of the stack of sheets, wherein the apex 28 of the arc type structure 27 is facing one of the walls of the dispenser, pushing the stack of sheets 5 towards the opening 3 in the dispenser 1. In another embodiment of the invention, the arc type structure 27 may be flexed and inserted between the stack of sheets 5 and the bottom wall 13, such that the apex 28 of the arc type structure is in communication with the stack of sheets.

A filler 30 may be positioned between said resilient member and said bottom wall of said dispenser, thereby putting more stress on the resilient member, which in turns allows the coupons to be dispensed with greater ease. The filler 30 is preferably made of a unitary piece, which folds up to form a small box like structure which fits within the dispenser.

To attract attention, the dispenser may further comprise a specialized advertising tag, known as a shouter 34. The shouter 34 is used to draw attention to the dispenser, and is comprised of a display area for printed matter, known as the head 35, integrally (preferably) attached to a leg 36, wherein one end of the leg is attached to the head, and the other end of the leg is inserted into a slot 37 in the dispenser, allowing for the display of the printed matter. In a preferred embodiment, the shouter further comprises a foot 38, integrally attached to the leg 36 at the end which is inserted into the slot 37 in the dispenser. The foot 38 is a tab which is turned upward, thus serving the purpose of securing the shouter 34 in the dispenser 1. A split 39 in the head 35 from the leg 36 further helps to secure the shouter 34 to the dispenser.

The dispenser 1 is preferably secured to the shelf. There are a number of methods to attach the dispenser to the shelf. One method for attaching the dispenser to the shelf is a rail clip attachment 40 for attachment to a rail of a shelf. The rail clip attachment 40 is attached to the flat bottom wall 13 of the dispenser, and comprises a base member 41, two brackets 42, 43 intersecting and extending outwardly from the base member, the brackets having, at their ends, foot-like projections 44, 45 facing away from each other and fitting into retaining rails of a shelf, at least one hole 46, 47 in each of the brackets, and a screw 48, fitted through the holes in the brackets whereupon the tightening or loosening of the screw pushes together or allows for the expansion of the two brackets, thereby allowing for a placement or removal of the device on a shelf edge.

There are many other methods and devices for attaching this dispenser to a shelf or wall. Any of them may be used.

Many modifications and variations of the present invention are possible in light of the above teachings. It is, therefore, to be understood within the scope of the appended claims the invention may be protected otherwise than as specifically described.

What is claimed is:

1. A dispenser for dispensing individual flexible sheets from a stack of said sheets having a first sheet and a last sheet, said dispenser comprising:

walls defining a cavity adapted to receive said stack of sheets, said walls including;

a first wall having an opening through which said sheets may be individually dispensed;

a second wall spaced from said first wall;

a first pair of opposite walls having edges positioned along edges of the width of said first and second walls at opposite sides thereof and connecting the first and second walls; and a second pair of opposite walls having edges positioned along edges of the length of said first and second walls at opposite sides thereof and connecting the first and second walls and the first pair of walls; and a biasing structure positioned within said cavity in contact with the last sheet of said stack of sheets to bend said stack of sheets and bias said stack of sheets toward said opening;

wherein each flexible sheet from said stack of sheets is independent from one another and folded upon itself at a specific length so that an end of the first sheet is positioned at the opening in the first wall.

2. The dispenser of claim 1, wherein said biasing structure includes an arcuate surface contacting said last sheet.

3. The dispenser of claim 2, wherein said biasing structure is a plastic sheet formed into an arc shape.

4. The dispenser of claim 3, wherein said sheet is rectangular when flat.

5. The dispenser of claim 1, wherein said first wall is a top and said second wall is a bottom.

6. A dispenser for dispensing individual flexible sheets from a stack of said sheets having a first sheet and a last sheet, said dispenser comprising:

walls defining a cavity adapted to receive said stack of sheets, said walls including;

a first wall having an opening through which said sheets may be individually dispensed;

a second wall spaced from said first wall;

a first pair of opposite walls having edges positioned along edges of the width of said first and second walls at opposite sides thereof and connecting the first and second walls; and a second pair of opposite walls having edges positioned along edges of the length of said first and second walls at opposite sides thereof and connecting the first and second walls and the first pair of walls; and a biasing structure positioned within said cavity in contact with the last sheet of said stack of sheets to impart a bend in said stack of sheets and bias said stack of sheets toward said opening;

wherein each flexible sheet from said stack of sheets is independent from one another and folded upon itself at a specific length so that an end of the first sheet is positioned at the opening in the first wall;

wherein said bend in said stack of sheets causes said end of said first sheet to be spaced from said stack of sheets.

7. The dispenser of claim 6, wherein said end extends through said opening.

8. A dispenser for dispensing individual flexible sheets from a stack of said sheets having a first sheet and a last sheet, said dispenser comprising:

walls defining a cavity adapted to receive said stack of sheets, said walls including;

a first wall having an opening through which said sheets may be individually dispensed;

a second wall spaced from said first wall;

a first pair of opposite walls having edges positioned along edges of the width of said first and second walls at opposite sides thereof and connecting the first and second walls; and a second pair of opposite walls having edges positioned along edges of the length of said first and second walls at opposite sides thereof and connecting the first and second walls and the first pair of walls; and a biasing structure positioned within said cavity in contact with the last sheet of said stack of sheets to impart a bend in said stack of sheets and bias said stack of sheets toward said opening;

wherein each flexible sheet from said stack of sheets is independent from one another and folded upon itself at a specific length so that an end of the first sheet is positioned at the opening in the first wall;

wherein said first wall is a top and said second wall is a bottom;

wherein said first pair of opposite walls are end walls and said second pair of opposite walls are side walls.

9. The dispenser of claim 8, wherein said top and bottom are parallel.

10. The dispenser of claim 9, wherein said end walls are parallel and said side walls are parallel.

11. The dispenser of claim 10, wherein said end walls are perpendicular to said side walls and said top and bottom.

12. The dispenser of claim 11, wherein said side walls are larger than said end walls.

13. A dispenser for dispensing individual flexible sheets from a stack of said sheets having a first sheet and a last sheet, said dispenser comprising:

walls defining a cavity adapted to receive said stack of sheets, said walls including;

a first wall having an opening through which said sheets may be individually dispensed;

a second wall spaced from said first wall;

a first pair of opposite walls having edges positioned along edges of the width of said first and second walls at opposite sides thereof and connecting the first and second walls; and a second pair of opposite walls having edges positioned along edges of the length of said first and second walls at opposite sides thereof and connecting the first and second walls and the first pair of walls; and a biasing structure positioned within said cavity in contact with the last sheet of said stack of sheets to impart a bend in said stack of sheets and bias said stack of sheets toward said opening;

wherein each flexible sheet from said stack of sheets is independent from one another and folded upon itself at a specific length so that an end of the first sheet is positioned at the opening in the first wall;

further including an angular formation positioned between the first wall and one of said first pair of opposite walls.

14. The dispenser of claim 13, wherein the angular formation is partially cut from the first wall to define the opening.

15. The dispenser of claim 13, wherein said biasing structure is positioned within said cavity adjacent one of said first pair of opposite walls opposite said angular formation.

* * * * *